United States Patent [19]

Oltman et al.

[11] Patent Number: 4,714,158

[45] Date of Patent: Dec. 22, 1987

[54] MOLDED TOOL TRAY ASSEMBLY

[75] Inventors: John P. Oltman; Donald N. Sulentic; Richard D. Purchase, all of Cedar Falls, Iowa

[73] Assignee: Waterloo Industries, Inc., Waterloo, Iowa

[21] Appl. No.: 910,866

[22] Filed: Sep. 24, 1986

Related U.S. Application Data

[63] Continuation of Ser. No. 764,343, Aug. 12, 1985, abandoned.

[51] Int. Cl.[4] ..... A45C 11/26

[52] U.S. Cl. ..... 206/349; 206/372; 206/373; 206/378; 206/561; 312/DIG. 33; 220/22; 220/94 R; 190/117; 16/110 R; 16/126

[58] Field of Search ..... 206/224, 349, 372, 373, 206/374, 375, 376, 378, 549, 557, 561, 569, 570, 516; 312/DIG. 33; 220/20, 91, 21, 22, 23, 91, 94 R, 95, 96; 190/115, 116, 117, 118; 16/110 R, 110.5, 126

[56] References Cited

U.S. PATENT DOCUMENTS

| | | | |
|---|---|---|---|
| D. 176,844 | 2/1956 | Evans | 206/373 |
| 547,549 | 10/1895 | Hood | 206/372 |
| 1,268,124 | 6/1918 | Jennings | 206/349 |
| 1,449,267 | 3/1923 | Cole | 220/96 |
| 1,596,951 | 8/1926 | Smith | 206/375 |
| 1,614,910 | 1/1927 | Yarder | 206/373 |
| 1,757,208 | 5/1930 | Nicholls | 220/94 R |
| 1,984,345 | 12/1934 | Kennedy | 312/DIG. 33 |
| 2,414,708 | 1/1947 | Bassichis | 220/96 |
| 2,457,043 | 12/1948 | Histand | 206/4 |
| 2,501,572 | 3/1950 | Marquez | 220/96 |
| 2,740,517 | 4/1956 | Evans | 220/94 R |
| 3,113,696 | 12/1963 | Kubodera | 220/96 |
| 3,321,117 | 6/1967 | Hediw | 223/107 |
| 3,464,586 | 9/1969 | Hitzeroth | 220/94 R |
| 3,586,200 | 6/1971 | Kramer | 220/94 R |
| 3,589,554 | 6/1971 | Smith | 220/20 |
| 3,618,749 | 11/1971 | Vaccaro | 206/372 |
| 3,628,843 | 12/1971 | Wynne | 206/373 |
| 3,647,104 | 3/1972 | Goings | 220/20 |
| 3,887,103 | 6/1975 | Spooner | 206/373 |
| 3,892,331 | 7/1975 | Beck | 312/DIG. 33 |
| 3,907,195 | 9/1975 | Struble | 229/41 B |
| 4,058,210 | 11/1977 | Mitchell | 312/DIG. 33 |
| 4,190,155 | 2/1980 | Higley | 16/110.5 |
| 4,215,789 | 8/1980 | Pfeifer | 220/96 |
| 4,227,430 | 10/1980 | Jansson et al. | 16/110.5 |
| 4,240,171 | 12/1980 | Derbyshire | 16/110.5 |
| 4,337,860 | 7/1982 | Carrigan | 206/376 |
| 4,353,465 | 10/1982 | Rado | 206/378 |
| 4,364,150 | 12/1982 | Remington | 190/115 |
| 4,522,288 | 6/1985 | Wickman et al. | 190/115 |
| 4,531,645 | 7/1985 | Tisbo et al. | 312/DIG. 33 |

FOREIGN PATENT DOCUMENTS

| | | | |
|---|---|---|---|
| 1166967 | 11/1958 | France . | |
| 821893 | 10/1959 | United Kingdom | 220/91 |
| 1070961 | 6/1967 | United Kingdom . | |

*Primary Examiner*—Stephen Marcus
*Assistant Examiner*—David T. Fidei
*Attorney, Agent, or Firm*—Allegretti, Newitt, Witcoff & McAndrews, Ltd.

[57] ABSTRACT

A tool tray assembly for use in a tool chest is disclosed. The assembly includes a tray member, a rotatable, lockable handle attached to the tray member, and a storage box adapted to rest in the tray member.

6 Claims, 14 Drawing Figures

22
48
44
22

42
46
110
108
102
100
106
74
72

64
68
62
66
24
70
102

82
7
80
78
84
7

74
84
76
72
76

60
32
52
86
62
28
58
60
26
30
50
40
54
36
62
88
94
90
92
20
38
86

86

FIG. 10
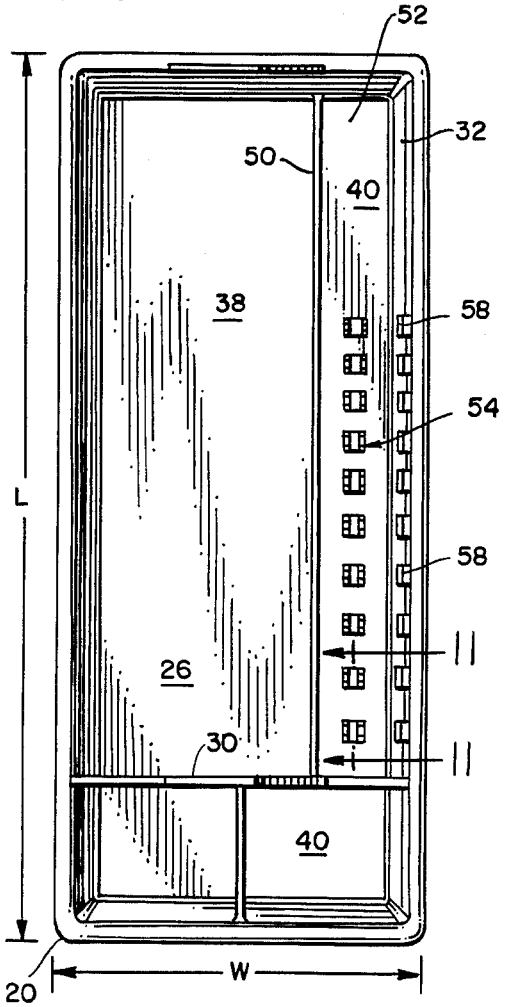
FIG. 11
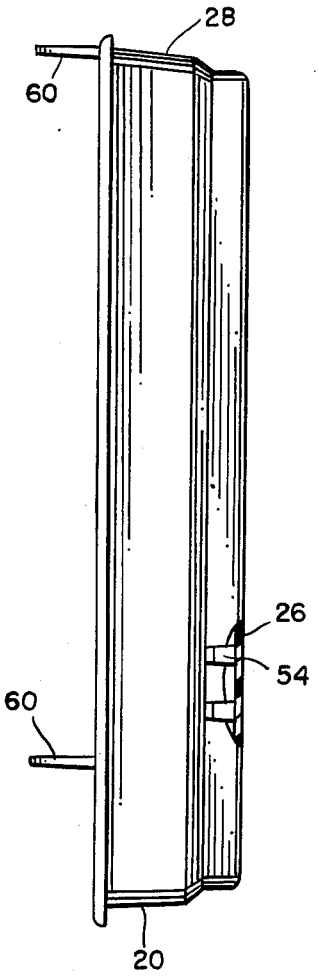
FIG. 12
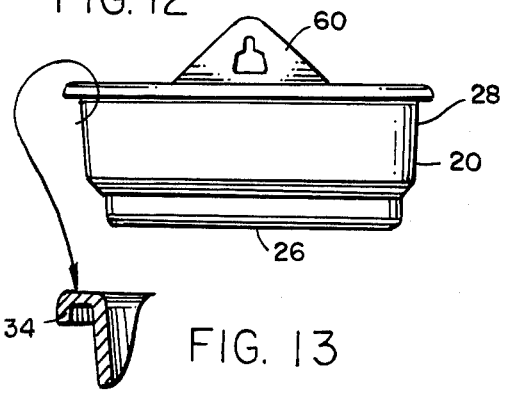
FIG. 13
FIG. 14
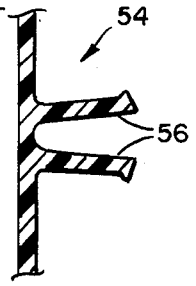

MOLDED TOOL TRAY ASSEMBLY

This application is a continuation of application Ser. No. 764,343, filed Aug. 12, 1985, now abandoned.

BACKGROUND OF THE INVENTION

The present invention relates generally to a tool chest and more particularly to a tool tray assembly.

Portable tool chests are well-known and available in a variety of shapes and sizes. One particular type includes a removable tray which fits within the chest resting upon a shelf. The tool tray increases the effective storage area, facilitates access to the contents of the chest, and improves content organization.

SUMMARY OF THE INVENTION

The present invention is an improved tool tray assembly for use in conjunction with a tool chest. The tool tray assembly fits within and is removable from the tool chest. Significantly, the present invention increases storage capacity and improves storage organization by and through the provision of a variety of storage areas.

The improved tool tray assembly includes a generally rectangular tray member which is partitioned to provide a tray compartment and a storage compartment. A removable storage box fits within the storage compartment.

A handle spans the tray compartment between a pair of flanges. The handle is at least partially hollow so as to define a handle storage area, closed, for example, by a snap-fit lid. The handle is rotatable between an inoperative position, i.e., where the handle substantially aligns with the tray member, and an operative or upright position.

The handle and the flanges cooperate to define a locking structure whereby the handle is lockable in the operative position. So locked, the handle is secured with respect to the tray member so as to avoid spillage of tray contents during transport.

It is thus an object of the present invention to provide an improved tool tray assembly. Another object is a tool tray assembly having a variety of storage areas.

Still another object is an improved tool tray assembly having a rotatable, yet lockable handle. It is a further object of the present invention to provide a readily and inexpensively manufactured tool tray assembly for use in a tool chest.

These and other features, objects and advantages of the present invention are described or implicit in the following detailed description.

BRIEF DESCRIPTION OF THE DRAWING

A preferred embodiment of the present invention is described, in detail, with reference to the drawing wherein:

FIG. 10 is a top view of the tray member shown in FIG. 2;

FIG. 11 is a side, partial cross sectional view of the tray member shown in FIG. 10 taken, in part, along 11—11;

FIG. 12 is an end view of the tray member shown in FIG. 10;

FIG. 13 is a partial cross sectional view of the tray member shown in FIG. 10 taken along 13—13; and FIG. 14 is a partial cross sectional view of the tray member shown in FIG. 10 taken along 14—14.

DETAILED DESCRIPTION OF THE PREFERRED EMBODIMENT

Figure 1:
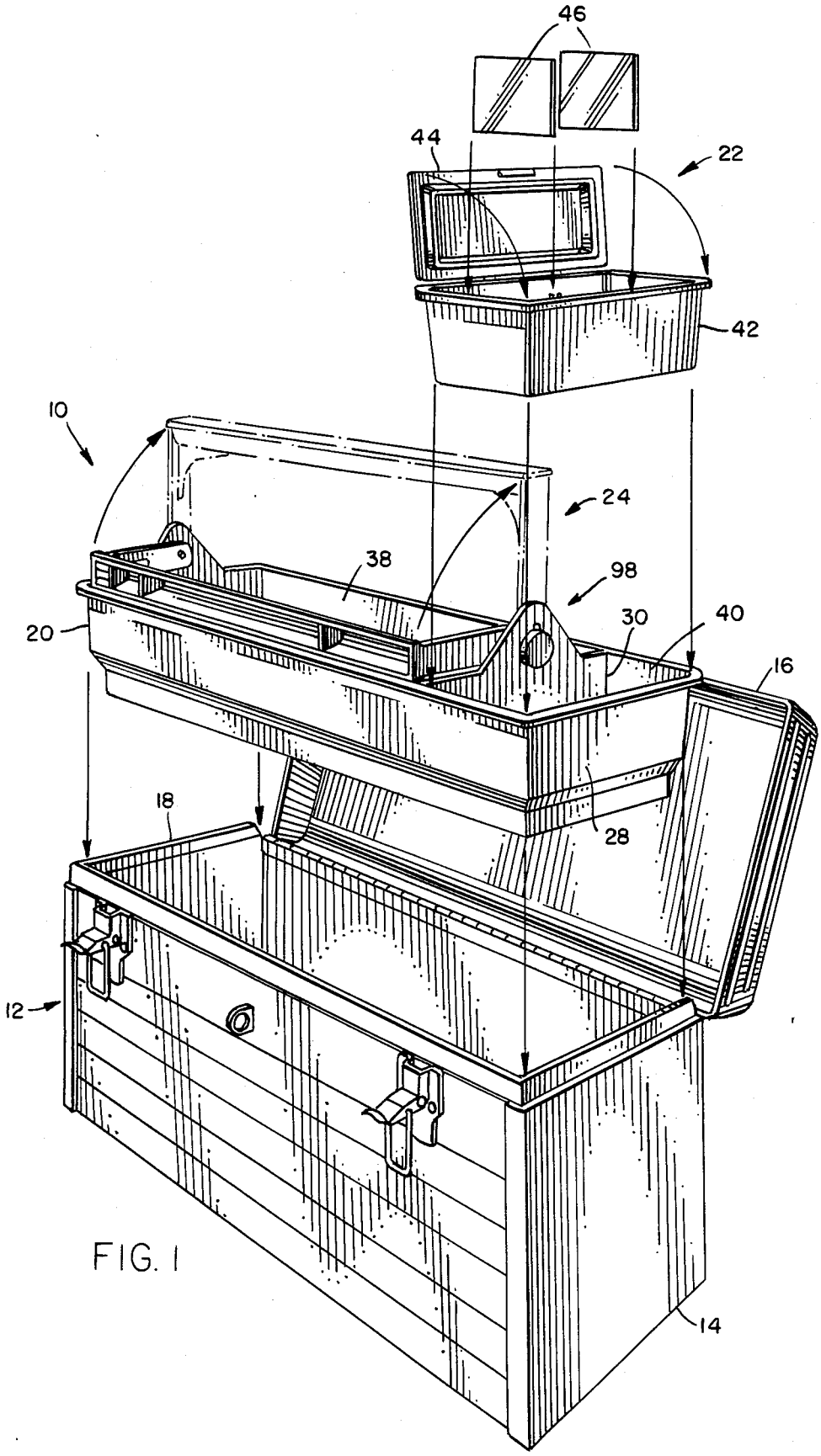
FIG. 1 is an exploded perspective view of a tool chest including a preferred embodiment of the present invention.

A preferred embodiment of the present invention is shown in the drawing as a tool tray assembly 10 for use in conjunction with a tool chest 12. As shown in FIG. 1, the tool chest 12 includes a generally rectangular cabinet 14 and a hingedly-connected, lockable cover 16. The cabinet 14 terminates in an upwardly extending, recessed flange 18.

The tool tray assembly 10 is adapted to fit within the cabinet 14 of the tool chest 12, engaging or resting upon the recessed flange 18. The recession of the flange 18 substantially avoids any interference between the tool tray assembly 10 and cover 16 in the assembled state.

The tool tray assembly 10 includes tray member 20, a removable storage box 22, and a rotatable, yet lockable handle 24. In this preferred embodiment, the tray member 20 is integral and thermoformed to minimize production costs. The tray member 20 could be aluminum or any other light weight material.

As best shown in FIGS. 2, 5–8, and 10–14, the tray member 20 is substantially rectangular and includes a bottom 26, sidewall 28, and interior partition 30. Preferably the sidewall 28 tapers or narrows, gradually and by offset, towards the bottom 26 of the tray member 20. This taper facilitates placement of the tool tray assembly 10 in the tool chest 12. The offset provides a readily visible, display surface 32 extending the perimeter of the tray member 20. Referring to FIG. 13, the sidewall 28 terminates, opposite the bottom 26, in a turned-over lip 34 adapted to securingly engage the recessed flange 18.

The bottom 26 and sidewall 28 of the tray member 20 define a tray cavity, generally designated 36, having a predetermined length "L" and width "W" corresponding generally to the dimensions of the tool chests 12. The interior partition 30, secured to the sidewall 28, divides the tray cavity 36 into a tray compartment 38 and a storage compartment 40.

As shown, the removable storage box 22 is adapted to fit securely and snuggly within the storage compartment 40. In this preferred embodiment, the storage box 22 is a durable plastic material, molded into an integral box portion 42 and lid portion 44. The box portion 42 includes stays, generally designated 46, adapted to securely and positionally holds at least two box partitions 48. The storage box 22 is particularly suited for storage of small items such as nails, screws, etc.

Figures 2, 3, 4, 5, 6, 7, 8, 9:
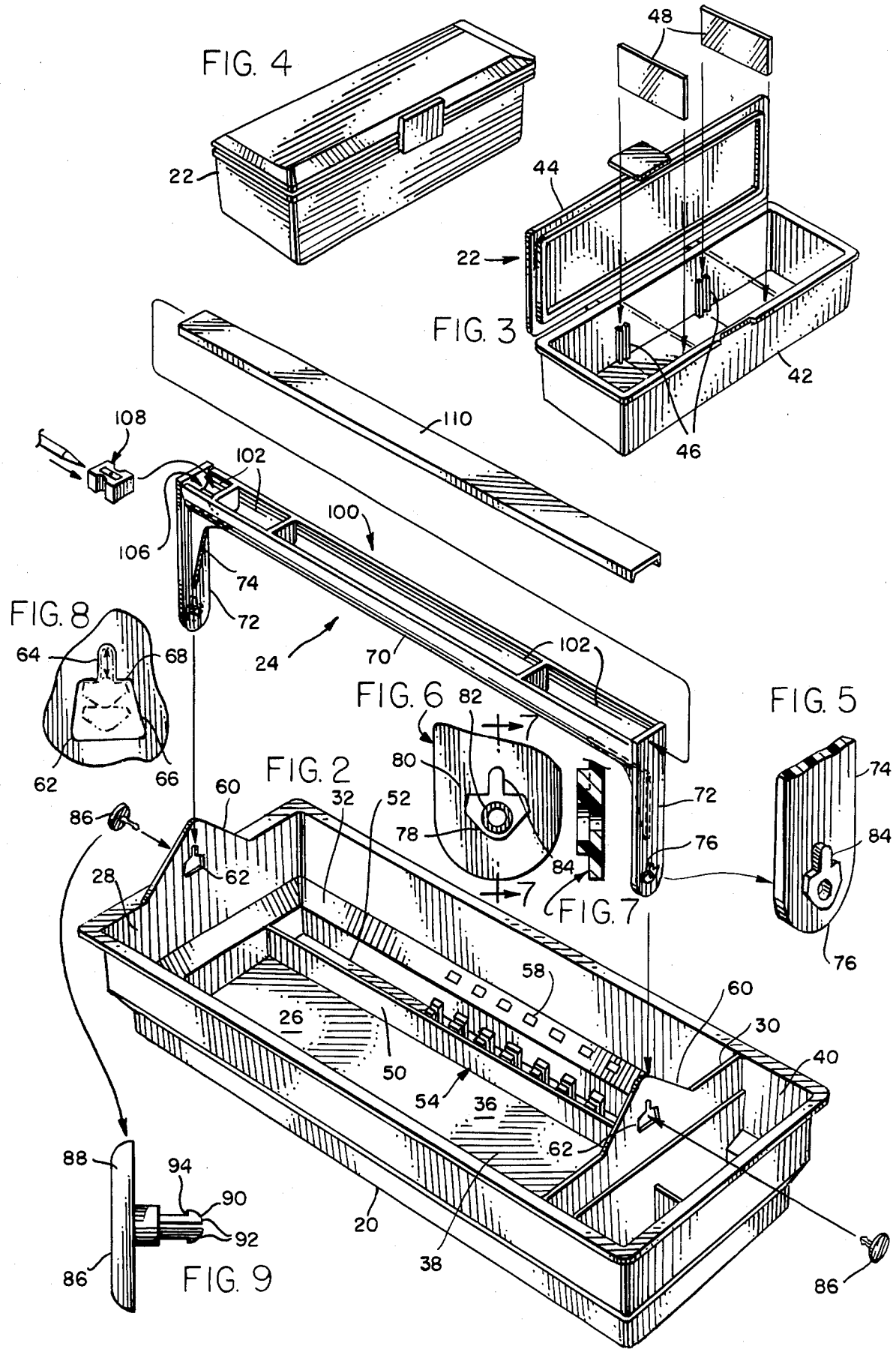
FIG. 2 is an enlarged, exploded perspective view of the tray member and handle of the preferred embodiment shown in FIG. 1.
FIG. 3 is an enlarged, exploded perspective view of the storage box of the preferred embodiment shown in FIG. 1.
FIG. 4 is an enlarged perspective view of the storage box of FIG. 3 with the lid thereof closed.
FIG. 5 is an enlarged, partial perspective view of the end portion of the handle shown in FIG. 2.
FIG. 6 is an end view of the handle end portion shown in FIG. 5.
FIG. 7 is a cross sectional view of the handle end portion shown in FIG. 6 taken along 7—7.
FIG. 8 is a partial end view of the handle-engaging flange of the tray member shown in FIG. 2.
FIG. 9 is a side view of the handle pin shown in FIG. 2.

Referring again to FIG. 2, the tray compartment 38 is partially subdivided by a second partition 50, extending from the bottom 26 along the length of the tray cavity 36. As shown, the second partition 50 sets off a small segment 52 of the tray compartment 38, wherein a series of socket receivers, generally designated 54, extend upwardly from the bottom 26. Referring to FIGS. 2, 10, and 14, the socket receivers 54 are adapted to securely hold the sockets of a socket wrench set (not shown). Each receiver 54 includes a pair of legs 56 having a skewed relationship, i.e., diverging away from the bottom 26 of the tray member 20. As such, the socket "snap-fits" onto the socket receiver 54. Indicia 58 of socket size is placed upon the display surface 32 adjacent each socket receiver 54. The size indicia may be a label adhesively applied to the display surface 32 or molded therein.

Referring primarily to FIGS. 2 and 8, the tool tray assembly 10 further includes a pair of substantially triangular flanges 60. The flanges 60 extend from the sidewall 28 and interior partition 30 away from the bottom 26. As shown, the flanges 60 are centrally aligned with respect to the width of the tray cavity 36 and substantially parallel.

The flanges 60 include or define substantially aligned, centrally-located handle apertures 62. Each handle aperture 62 includes an upper, substantially upright locking slot 64 and a lower, rotation-permitting opening 66. In this preferred embodiment, the rotation-permitting opening 66 is substantially trapezoidal, having rounded corners and defining an upper catch surface 68.

The handle 24 spans the tray compartment 38 and is secured to the flanges 60 via the handle apertures 62. More particularly, the handle 24 includes a grasping portion 70 and a pair of end portions 72, extending substantially perpendicular from the grasping portion 70. As shown, the handle 24 also includes reinforcing flanges 74 further interconnecting the grasping portion 70 and end portions 72 for rigidity and strength.

Referring to FIG. 5, a tab 76 extends outwardly from each end portion 72 of the handle 24. In this preferred embodiment, the tab 76 has a support portion 78, defining an upper support surface 80 and a central tab opening 82, and a key portion 84 extending therefrom.

The tab 76 is dimensioned to easily fit within and pass through the rotation-permitting opening 66 of the handle aperture 62, thereby facilitating assembly. Further, whenever the tab 76 is positioned within the rotation-permitting opening 66, the handle 24 is rotatably approximately 180° between two inoperative positions and a substantially upright, operative position. In the inoperative positions, the handle 24 lies substantially adjacent and inside the sidewall 28 between the flanges 60. In the operative position, the handle 24 is substantially upright and the grasping portion 70 thereof is readily accessible for removal of the tool tray assembly 10 from the tool chest 12.

The handle 24 is secured by means of a handle pin 86, adapted to engage the flange 60 and the end portion 72 of the handle 24. As shown in FIG. 9, the handle pin 86 includes a head portion 88 and handle-engaging portion 90. The head portion 88 is substantially cylindrical and encompasses the handle aperture 62 of the flange 60 in the assembled state. The handle-engaging portion 90, including flexible legs 92 defining an interlock surface 94, is adapted to pass through the central tab opening 82, such that the interlock surface 94 engages and locks against the innermost surface 96 of the handle end portion 72.

In the upright, operative position of the handle 24, the key portion 84 of the tab 76 substantially vertically aligns with the locking slot 64 of the handle aperture 62. With application of an upright or lifting force, there is engagement of the support surface 80 and the key portion 84 with the catch surface 68 and the locking slot 64, respectively, thereby securing the tray member 20 with respect to the handle 24.

As such, the handle 24 and the flanges 60 cooperate to define lock means, generally designated 98, for selectively securing or locking the handle 24 with respect to the tray member 20, i.e., in the operative position. Transport of the tool tray assembly 10 is thus facilitated in that the tray member 20, so secured, will not rotate or tip to the degree necessary to spill the contents thereof.

As best shown in FIG. 2, the grasping portion 70 of the handle 24 is preferably hollow so as to define a handle storage area, generally designated 100. The handle storage area 100 is divided into a series of handle storage compartments 102 by handle partitions 104. One such handle storage compartment 102 is adjacent one end portion 72, which defines a pencil opening 106 providing access into the handle storage area 100. A pencil sharpener 108 snuggly fits in this compartment 102, appropriately aligned with the pencil opening 106. The handle storage area 100 is preferably closed by a "snap-fit" on "slide-on" transparent closure or cover 110.

A single preferred embodiment of the present invention has been described herein. It is to be understood, however, that various changes and modifications can be made without department from the true scope and spirit of the present invention as defined by the following claims. These claims are to be interpreted in view of the foregoing description.

What is claimed is:

1. A tray assembly comprising, in combination:

a substantially rectangular tray member having a bottom, a sidewall and at least a first interior partition, said bottom and said sidewall defining a tray cavity having a predetermined length and width, said first interior partition secured to said sidewall across said width of said tray cavity so as to define a tray compartment and a storage compartment within said tray cavity;

a removable storage box adapted to securely fit within said storage compartment;

a pair of substantially parallel flanges extending from said sidewall and said first interior partition, said substantially parallel flanges being centrally aligned with respect to said width of said tray cavity, said substantially parallel flanges defining substantially aligned handle apertures; and a handle extending between said substantially parallel flanges and including a grasping portion connecting two end portions, said end portions defining a pair of oppositely extending tabs adapted to engage said substantially aligned handle apertures, said handle being selectively rotatably between an operative position wherein the grasping portion may be manually encircled for grasping and carrying, and an inoperative position, said handle lying substantially adjacent and inside said sidewall in said inoperative position, whereby access is provided to the tray member and the handle does not overextend the side wall, each of said substantially aligned handle apertures of said substantially parallel flanges including an upper substantially upright locking slot and a lower rotation-permitting opening, each of said oppositely extending tabs being rotatable with substantial freedom within said lower rotation-permitting opening of said substantially aligned handle apertures, said oppositely extending tabs including a key portion adapted to engage said upper substantially upright locking slot in said operative position;

said substantially parallel flanges and said handle end portions cooperatively defining lock means for selectively securing said handle in said operative position, whereby said substantially rectangular tray member is secured with respect to said handle; and said handle grasping portion defining a handle storage area therein and including closure means for closing said handle storage area.

2. A tray assembly as claimed in claim 1 wherein said sidewall includes a peripheral lip.

3. A tray assembly as claimed in claim 1 further comprising a series of socket receivers secured to said bottom of said substantially rectangular tray member within said tray compartment.

4. A tray assembly as claimed in claim 1 wherein said sidewall tapers toward said bottom of said substantially rectangular tray member and defines a display surface.

5. A tray assembly as claimed in claim 4 further comprising a series of socket receivers secured to said bottom and size indicia on said display surface adjacent each of said socket receivers.

6. A tray assembly comprising, in combination:

a substantially rectangular tray member having a bottom, a sidewall and at least a first interior partition, said bottom and said sidewall defining a tray cavity having a predetermined length and width, said first interior partition. secured to said sidewall across said width of said tray cavity so as to define a tray compartment and a storage compartment within said tray cavity;

a removable storage box adapted to securely fit within said storage compartment;

a pair of substantially parallel flanges extending from said sidewall and said first interior partition, said substantially parallel flanges being centrally aligned with respect to said width of said tray cavity, said substantially parallel flanges defining substantially aligned handle apertures; and a handle extending between said substantially parallel flanges and including a grasping portion connection two end portions, said end portions defining a pair of oppositely extending tabs adapted to engage said substantially aligned handle apertures, said handle being selectively rotatable between an operation position wherein the grasping portion may be manually encircled for grasping and carrying, and an inoperative position, said handle lying substantially adjacent and inside said sidewall in said inoperative position whereby access is provided to the tray member and the handle does not overextend the side wall, at least one of said substantially aligned handle apertures of said substantially parallel flanges including an upper substantially upright locking slot and a lower rotation-permitting opening, a corresponding one of said oppositely extending tabs being rotatable with substantial freedom within said lower rotation-permitting opening of said one substantially aligned handle aperture, said corresponding one of said oppositely extending tabs including a key portion adapted to engage said upper substantially upright locking slot in said operative position; and said substantially parallel flanges and said handle cooperatively defining lock means for selectively securing said handle in said operative position, whereby said substantially rectangular tray member is secured with respect to sid handle.

* * * * *